US006846196B1

(12) United States Patent
Fallon

(10) Patent No.: US 6,846,196 B1
(45) Date of Patent: Jan. 25, 2005

(54) BIASING AND ADJUSTABLE EXTENSION CORD-RETAINING DEVICE FOR PREVENTING DISENGAGEMENT OF MALE-TO-FEMALE ADAPTOR PLUGS

(76) Inventor: Harry Fallon, 165 Quimby Rd., Coldwater, MI (US) 49036

( * ) Notice: Subject to any disclaimer, the term of this patent is extended or adjusted under 35 U.S.C. 154(b) by 0 days.

(21) Appl. No.: 10/650,864

(22) Filed: Aug. 28, 2003

(51) Int. Cl.[7] ..... H01R 13/62
(52) U.S. Cl. ..... 439/369
(58) Field of Search ..... 439/369, 370, 439/371, 373, 456–460, 451

(56) References Cited

U.S. PATENT DOCUMENTS

| | | | | |
|---|---|---|---|---|
| 1,266,776 A | | 5/1918 | Dietzel | |
| 4,319,800 A | | 3/1982 | Bernat | 339/218 |
| 4,515,423 A | | 5/1985 | Moore et al. | 339/28 |
| 4,768,974 A | * | 9/1988 | Cowan et al. | 439/371 |
| 4,875,874 A | | 10/1989 | Windsor, Jr. | 439/364 |
| 4,907,984 A | | 3/1990 | Keller | 439/369 |
| 4,907,985 A | | 3/1990 | Johnsen | 439/369 |
| 4,917,625 A | | 4/1990 | Haile | 439/358 |
| 5,129,839 A | | 7/1992 | VanSkiver | 439/367 |
| 5,166,995 A | | 11/1992 | Briggs et al. | 385/58 |
| 5,179,044 A | | 1/1993 | Muromachi et al. | 439/369 |
| 5,395,264 A | | 3/1995 | Keith | 439/502 |
| 5,454,728 A | | 10/1995 | Jack | 439/277 |
| 5,505,634 A | | 4/1996 | Osten | 439/369 |
| 5,685,732 A | * | 11/1997 | Lane | 439/369 |
| 6,273,732 B1 | * | 8/2001 | Johnescu et al. | 439/79 |

* cited by examiner

*Primary Examiner*—Ross Gushi
*Assistant Examiner*—Phuongchi Nguyen
(74) *Attorney, Agent, or Firm*—Gifford, Krass, Groh, Sprinkle, Anderson & Citkowski, P.C.

(57) ABSTRACT

A retaining device for use with interconnecting plug ends of first and second extending cords. A main gripping body exhibits a first pair of arcuately extending and spaced apart gripping portions. A secondary gripping body is slidably received within an axially extending aperture defined in the main gripping body and exhibits a second pair of arcuately extending and spaced apart gripping portions arrayed in opposing fashion relative the first pair of gripping portions. A cover plate is fixedly secured to the main gripping body, in overlaying fashion upon the axially extending aperture, the cover plate and secondary gripping body each further exhibiting a partially aligning and extending recess. A coil spring seats within the aligning portions of the first and second recesses and in order to retain the secondary gripping body relative the main gripping body and to bias the first and second pairs of gripping portions in a direction towards one another, thereby biasingly engaging the opposite plug ends of the first and second extending cords.

12 Claims, 3 Drawing Sheets

BIASING AND ADJUSTABLE EXTENSION CORD-RETAINING DEVICE FOR PREVENTING DISENGAGEMENT OF MALE-TO-FEMALE ADAPTOR PLUGS

BACKGROUND OF THE INVENTION

1. Field of the Invention

The present invention relates generally to extension cord-retaining and securing devices. More particularly, the present invention discloses an improved adjustable and inwardly resiliently biased extension cord-retaining device for securing together interconnected male and female adapter plugs.

2. Description of the Prior Art

The prior art is well documented with examples of devices specifically suited for retaining or ensuring the existing connection between male and female ends of such as power extension cords, communication lines and the like. A known shortcoming of existing male-to-female plug connections is the tendency of the plugs to become disengaged in response to inadvertent pulling or jerking forces along a cord extending from either the male or female connecting side.

A first known example of an adjustable extension cord-retaining device is set forth in U.S. Pat. No. 5,685,732, issued to Lane. A first planar shaped member is provided and includes a flattened body portion and a first pair of angularly extending and spaced gripping members. A second planar shaped member includes a pair of spaced apart and axially extending legs which receive the flattened body portion of the first planar member in a coplanar fashion and a second pair of angularly extending and spaced apart gripping members which are arranged opposite the first pair of gripping members. An upper plate and a lower plate sandwich the first and second planar-shaped members and fasteners secure the stacked arrangement together. The arrangement of the first and second planar-shaped members permits the first member to be axially slidable relative to the second member and a coil spring is employed to introduce an inward resilient bias to the opposing pairs of gripping portions to maintain contact with the male and female adapters.

Canadian Patent No. 818,717 issued to Bloom teaches an extension cord clamp including slidably moveable components having a ratchet and detent mechanism. Opposing and integral extending end portions are associated with each of the slidably moveable components, the components further being releasably fastened in any one of a plurality of set positions and, in combination with the extending end portions, hold various sizes of electric cord terminals in an electrically connected relationship.

U.S. Pat. No. 4,917,625 issued to Haile teaches a Snap-On Electrical Connector for Electrical Cords Having Mating Plugs. The connector includes springable arms having shoulders inter-engaging with shoulders formed on the adjacent ends of the plugs and in such a fashion as to lockably engage the plugs and thereby prevent separation of the cords during use. Within the connector there are provided electrical connector elements each having a female and a male end, adapted to mate with the electrical elements of the plugs, and thus providing a through electrical connection for the cords while assuring that they will be held against inadvertent separation.

U.S. Pat. No. 5,129,839 issued to VanSkiver teaches an extension cord connection housing for maintaining an interconnection between male and female electrical extension cord plugs of a pair of extension cords. A generally elongate housing is provided having an upper half and a lower half, which are hingedly coupled together along one edge in an axial direction. A latch is provided for selectively securing and maintaining the upper half and lower half of the housing together in an abutting relationship, forming an enclosure therein suitable for enclosing an interconnected male and female extension cord plug. A first aperture at one end of the housing is sized to receive an electrical extension cord while retaining a first plug within the housing. A slidably mounted plug retaining bracket is utilized to retain a second plug within the housing and a ratchet arrangement of angled slots and teeth are utilized to permit movement of the plug retaining bracket toward the first aperture while restricting movement in the opposite direction, thereby maintaining an interconnection between male and female extension cord plugs after urging the second plug toward the first plug.

Finally, U.S. Pat. No. 4,875,874 issued to Windsor, Jr. teaches an electrical connector securing arrangement for use upon the female socket of an extension cord, and in order to prevent the unintentional separation from the socket of a male plug that has been interfitted therewith. The connector securing arrangement comprises a socket having therein a pivotally mounted latch member rotatable between extreme positions that are more than 180 degrees apart, and a compatible male plug utilized with the socket. The rotatable latch member has a central locking portion able to releasably engage a portion of the plug when the rotatable latch member is in one position of its rotation, and thus effectively help prevent undesired separation of the socket and plug when interfitted. The central locking portion of the rotatable latch member is able to be stowed unobtrusively on a certain designated part of the body of the socket when the socket and the plug have been separated, and the rotatable latch member has been moved to an extreme position of its rotation. The stowing of the rotatable latch member in the unobtrusive location on the socket serves very effectively to prevent the same from becoming snagged on a nearby object during use.

SUMMARY OF THE PRESENT INVENTION

The present invention discloses an improved adjustable and inwardly resiliently biased extension cord-retaining device for securing together interconnected male and female adapter plugs. A main gripping body is provided and includes a substantially planar and rectangular shape, from which extends a first pair of spaced-apart and arcuately configured gripping portions.

A secondary gripping body defines a corresponding planar and rectangular shape and is slidably received within an axially extending aperture of matching configuration in the main gripping body. A second pair of spaced-apart and arcuately configured gripping portions extend from the second gripping body in opposing fashion to the first pair of gripping portions.

A cover plate is fixedly secured upon the main gripping body and in communication with the secondary gripping body. Both the cover plate and secondary gripping body each further include a partially aligning, communicating, and axially extending recess, within which is seated a coil spring. Upon gripping the secondary body and axially extending the same relative to the main body, the coil spring is compressed, resulting in an opposing and compressing force which causes the first and second pairs of gripping portions to be biased in a direction towards each other and in engaging fashion about respective and opposite plug ends of the first and second extending cords.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENT

Figure 1:
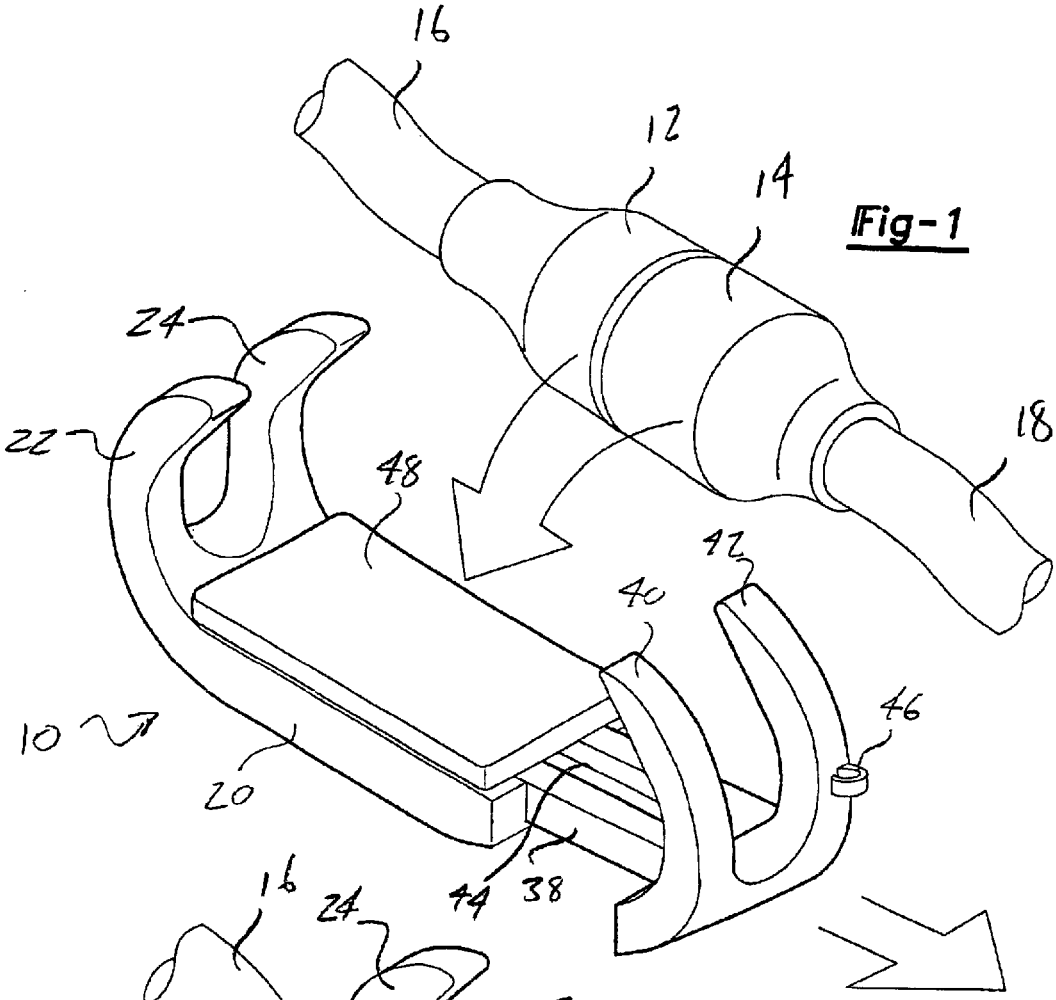
FIG. 1 is an environmental view in perspective and illustrating the extension cord-retaining device in an extended position prior to resilient engagement about interconnected male and female plug ends of first and second extension cords.
Figure 2:
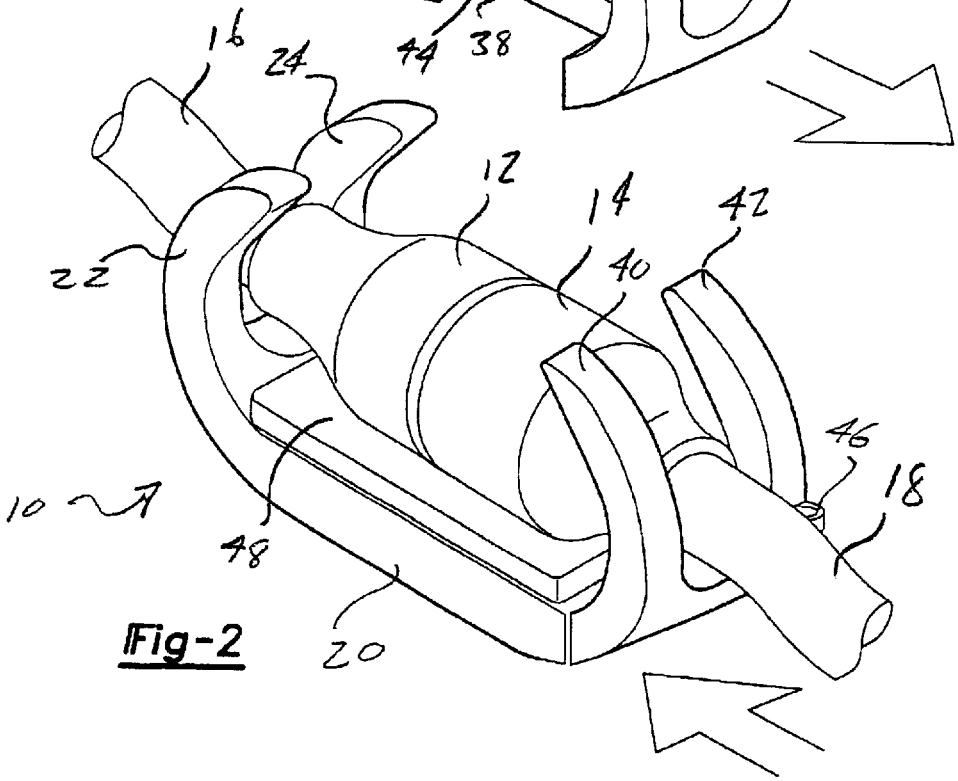
FIG. 2 is a succeeding illustration in perspective of the device illustrated in FIG. 1 and showing the extension cord-retaining device securely engaged about the interconnected male and female plug ends.
Figure 3:
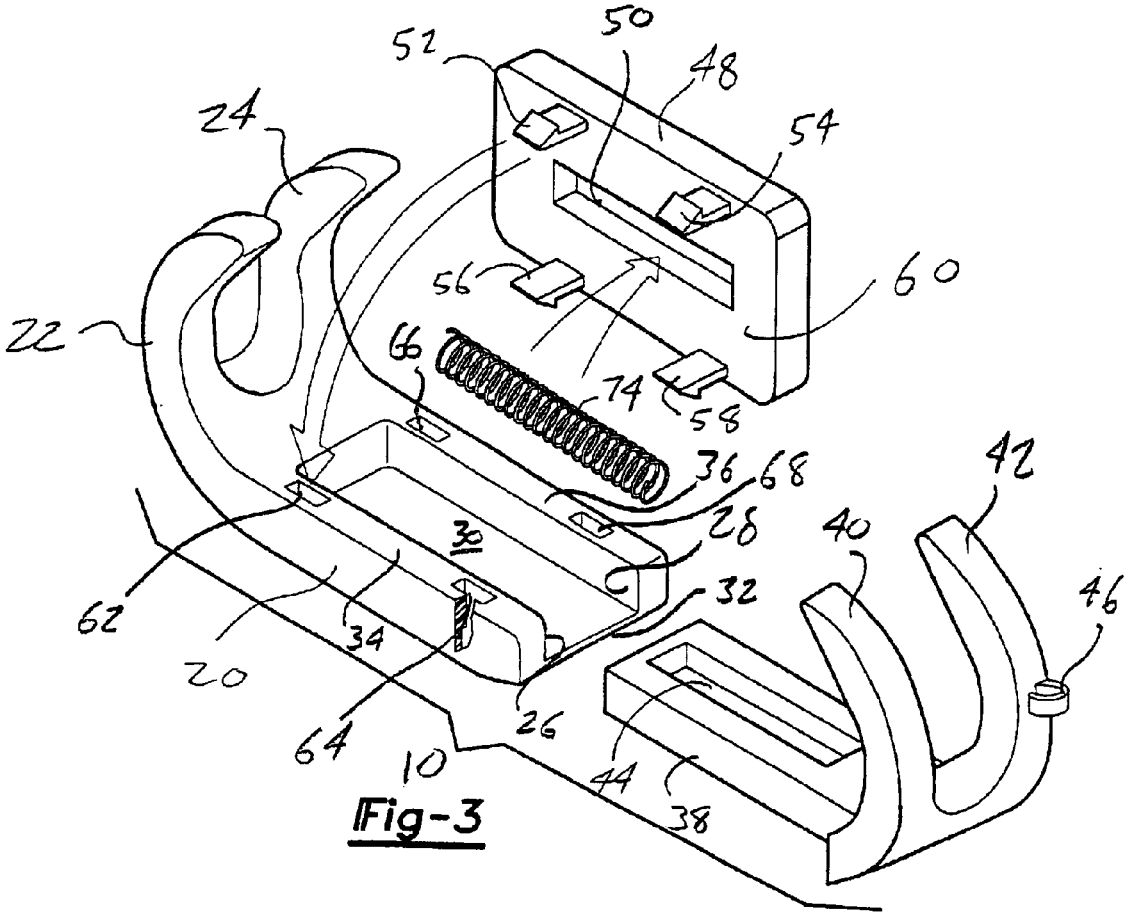
FIG. 3 is an exploded view of the extension cord-retaining device and illustrating the features of the main gripping body, slidably engageable and secondary gripping body, removable cover plate and biasingly sandwiched coil spring.

Referring now to FIGS. 1–3, an extension cord-retaining device is illustrated at 10, according to the present invention, and for use with first 12 and second 14 interconnected plug ends of associated first 16 and second 18 extension cords. The ends 12 and 14 typically correspond to male and female extension cord plugs, however it is further understood that the retaining device 10 of the present invention is capable of being utilized with interconnecting male and female plugs of any potential configuration.

A main gripping body is provided and includes a first substantially elongated and rectangular portion 20 and exhibiting a first pair of arcuately extending and spaced apart gripping portions 22 and 24. A pair of side walls 26 and 28 and bottom wall 30 (see exploded view of FIG. 3) extend axially inwardly from an associated end 32 of the elongated rectangular portion 20 of the main gripping body. The open recess created in the upper facing surface of the main gripping body is further defined by extending side walls 34 and 36 (see again FIG. 3).

A secondary gripping body is further illustrated by rectangular and elongate extending portion 38, and which is slidably received within the axially extending aperture (see again surfaces 26, 28 and 30) defined in the main gripping body. The secondary gripping body exhibits a second pair of arcuately extending and spaced apart gripping portions 40 and 42 opposing the first pair of gripping portions 22 and 24.

As will be further explained below, the first 22 and 24 and second 40 and 42 pairs of gripping portions are biased in a direction towards one another and in order to engage respective and opposite plug ends 12 and 14 of the first and second extending cords 16 and 18. Defined within four inwardly facing and interconnected sides and a bottom in communication with an upper facing surface of the elongate extending portion 38 is a closed and axial recess 44. An eyelet portion is further illustrated at 46 and such as which may provide a lanyard loop for supporting the device 10 from a string, line or the like.

A cover plate is illustrated at 48 and includes a substantially planar and rectangular shape corresponding to substantially to that of the body portion 20 of the main gripping body. The cover plate includes a second axially extending recess 50 defined within a lower face, similar in shape with the recess 44 associated with the secondary gripping body and aligning in part with said first extending recess 44 upon the cover plate 48 being affixed upon the main gripping body.

To facilitate engagement of the cover plate 48, a plurality of posts 52, 54, 56 and 58 project from a lower face 60 of the cover plate 48 (see again as best shown in FIG. 3). An aligning plurality of apertures are defined within the upper facing surfaces of the main gripping body, see again raised and axially extending sides 34 and 36, and are defined at 62, 64, 66 and 68 and within which are received corresponding posts 52, 54, 56 and 58.

Figure 6:
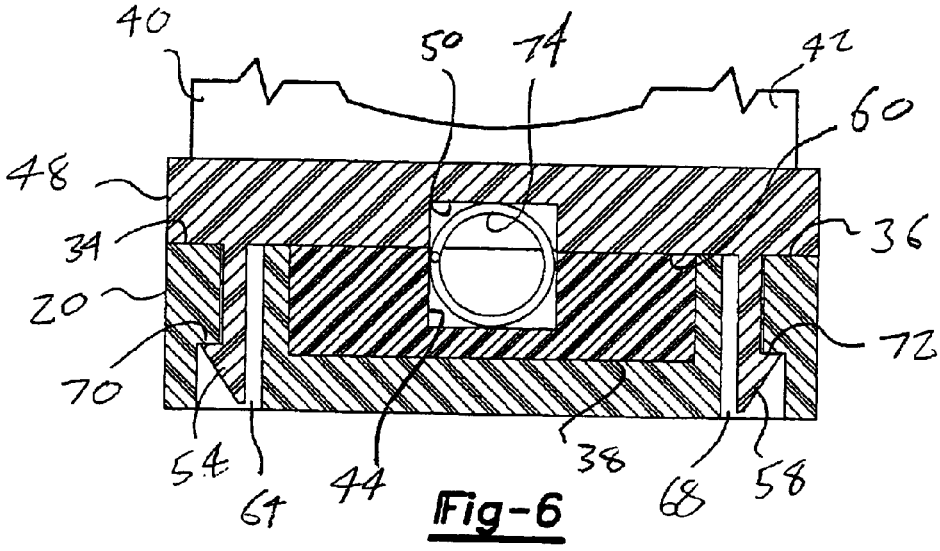
FIG. 6 is a cutaway view taken along line 6—6 of FIG. 4 and illustrating, in crosswise section, the biasing nature of the coil spring established between the relatively slidable main and secondary gripping bodies.

As best shown in the exploded view of FIG. 3 and the end cutaway view of FIG. 6, the posts 52, 54, 56 and 58 each further include angled end extending tabs. The aligning apertures in the main gripping body, and in particular apertures 64 and 68 illustrated in the end cutaway of FIG. 6, each further include a recessed and stepped shoulder, see as represented at 70 and 72 respectively, and upon which are lockingly engaged the corresponding end extending tabs 54 and 58. In this fashion, the cover 48 is securably engaged over the main gripping body and in communicating fashion with the secondary gripping body and further such that the axially extending apertures 44 and 50 are in at least partially aligning fashion.

Figure 4:
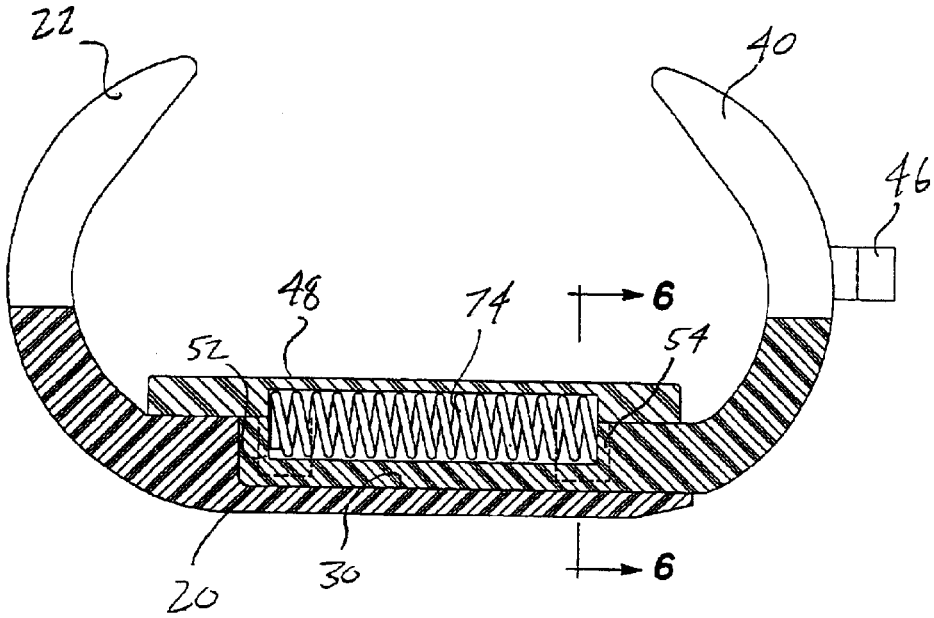
FIG. 4 is an axial cutaway in plan view illustrating the extension cord-retaining device in the fully retracted/engaged position of FIG. 2.
Figure 5:
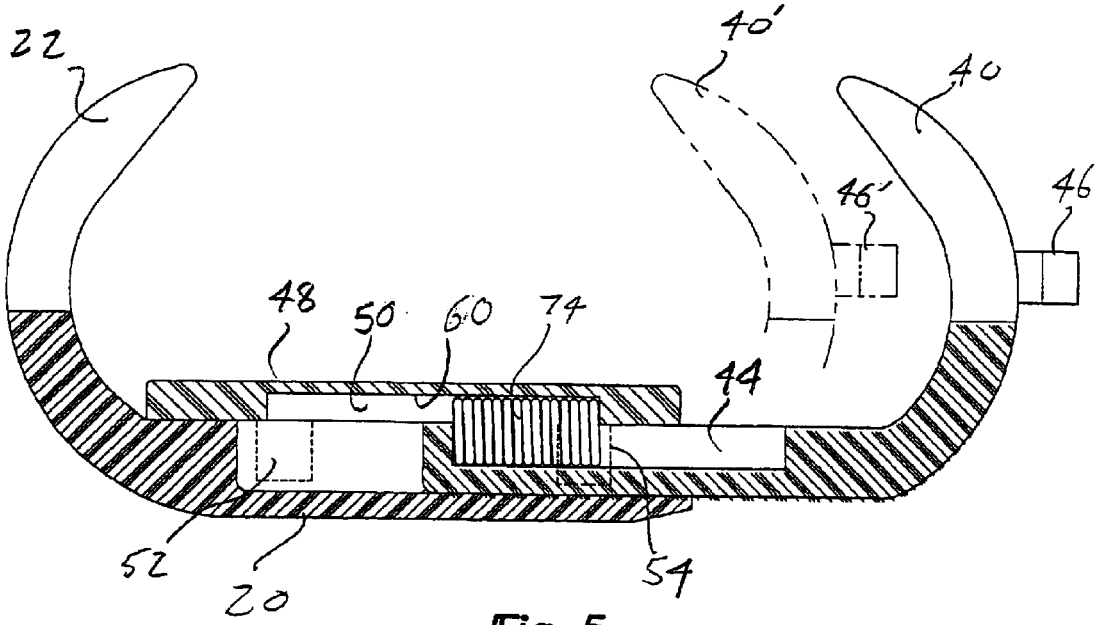
FIG. 5 is a succeeding axial cutaway in plan view of the extension cord-retaining device in the substantially extended position of FIG. 1.

As best illustrated in the cutaway side views of FIGS. 4 and 5, a coil spring 74 seats within the aligning portions of the first 44 and second 50 mating recesses of the secondary gripping body and cover, respectively, and prior to the cover 48 being secured over the portion 20 of the main gripping body. Also, it is worthwhile to point out that the existence of the coil spring 74 within the mating recesses 44 and 50 is what prevents the slidable disengagement of the secondary gripping portion 38 from the corresponding portion 20 of the main gripping body. It is also contemplated that the material construction of the main gripping body, secondary gripping body and cover can include a metal, durable polymer/plastic or other suitable material.

As is shown in FIGS. 4 and 5, the biasing action of the coil spring 74 is evident and such that, upon extracting the secondary gripping body to an outer-most expanded position (see FIGS. 1 and 5) the coil spring 74 is fully compressed. In response, the expanding forces exerted by the spring 74 will cause the pair of gripping portions 40 and 42 associated with the secondary gripping body to retract (see engaged position of FIG. 2 as well as retracted position 40 in FIG. 5) in a direction towards the first pair of gripping portions 22 and 24 (associated with the main gripping body). In this fashion the interconnecting plugs 12 and 14 are biasingly restrained together and in the fashion illustrated in FIG. 2.

Having described my invention, other and additional preferred embodiments will become apparent to those skilled in the art to which it pertains, and without deviating from the scope of the appended claims.

I claim:

1. A retaining device for use with interconnecting plug ends of first and second extending cords, said retaining device comprising:

a main gripping body having a three-dimensional and elongated rectangular configuration, a pair of side walls, end wall and recessed bottom wall defining an axially extending and open recess in said main gripping body, said body exhibiting a first pair of extending and spaced apart gripping portions;

a secondary gripping body slidably received within said axially extending and open recess defined in said main gripping body and seating upon said bottom wall, said second gripping body exhibiting a second pair of extending and spaced apart gripping portions opposing said first pair of gripping portions, said first and second pairs of gripping portions being biased in a direction towards one another and engaging respective and opposite plug ends of the first and second extending cords; and a cover plate secured to said main gripping body, in overlaying fashion upon said axially extending aperture, to retain said secondary gripping body relative said main gripping body.

2. The retaining device as described in claim 1, further comprising an eyelet portion extending from a selected one of said gripping portion selected from said first and second pairs of gripping portions.

3. The retaining device as described in claim 1, said retaining device having a specified shape and size and being constructed from a metal material.

4. The retaining device as described in claim 1, said retaining device having a specified shape and size and being constructed from a durable plasticized material.

5. The retaining device as described in claim 1, said secondary gripping body further comprising a first axially extending recess defined within an upper face, said cover plate further comprising a second axially extending recess defined within a lower face and aligning in part with said first extending recess, a coil spring seating within said aligning portions of said first and second recesses.

6. The retaining device as described in claim 5, said cover plate further comprising a plurality of posts projecting from said lower face, an aligning plurality of apertures being defined within upper facing surfaces of said main gripping body and within which are received said posts.

7. The retaining device as described in claim 6, said posts each further comprising angled end extending tabs, said aligning apertures in said main gripping body each further comprising a recessed and stepped shoulder and upon which are lockingly engaged said end extending tabs.

8. The retaining device as described in claim 1, said slidably inter-engaging portions of said main gripping body and said secondary gripping body each further comprising a substantially planar and rectangular shape.

9. The retaining device as described in claim 8, further comprising said first and second pairs of gripping portions extending in arcuate fashion, respectively, from said main gripping body and said secondary gripping body.

10. The retaining device as described in claim 8, said cover plate further comprising a substantially planar and rectangular shape correspondingly substantially to said configuration of said main gripping body.

11. A retaining device for use with interconnecting plug ends of first and second extending cords, said retaining device comprising:

a main gripping body having an axially extending and open recess;

a secondary gripping body slidably received within said main gripping body, said second gripping body seating within said open recess and being supported between spaced apart side walls and a bottom wall associated with said main gripping body;

first and second pairs of spaced apart gripping portions extending in opposing fashion and from opposite ends of said main body and secondary body, said first and second pairs of gripping portions being biased in a direction towards one another and engaging respective and opposite plug ends of the first and second extending cords; and a cover plate secured upon said main gripping body and in communication with said secondary body, said cover plate retaining said secondary gripping body relative said main gripping body and causing said secondary body to be biased in a direction towards said main body.

12. A retaining device for use with interconnecting plug ends of first and second extending cords, said retaining device comprising:

a main gripping body exhibiting a first pair of arcuately extending and spaced apart gripping portions;

a secondary gripping body slidably received within an open and axially extending recess defined in said main gripping body, said second gripping body being supported between side walls and a bottom wall associated with said open recess and exhibiting a second pair of arcuately extending and spaced apart gripping portions arrayed in opposing fashion relative said first pair of gripping portions;

a cover plate fixedly secured to said main gripping body, in overlaying fashion upon said axially extending aperture, said cover plate and said secondary gripping body each further exhibiting a partially aligning and extending recess; and a coil spring seating within said aligning portions of said first and second recesses in order to retain said secondary gripping body relative said main gripping body and to bias said first and second pairs of gripping portions in a direction towards one another and in engaging fashion with opposite plug ends of the first and second extending cords.

* * * * *